US005122028A

United States Patent [19]

Joubert

[11] Patent Number: 5,122,028

[45] Date of Patent: Jun. 16, 1992

[54] SKIP

[75] Inventor: Robert M. Joubert, Potchefstroom, South Africa

[73] Assignee: Rotaque (Proprietary) Limited, Potchesfstroom, South Africa

[21] Appl. No.: 660,569

[22] Filed: Feb. 25, 1991

[30] Foreign Application Priority Data

Feb. 26, 1990 [ZA] South Africa ..... 90/1439
Nov. 19, 1990 [ZA] South Africa ..... 90/9273

[51] Int. Cl.[5] ..... B66B 17/08
[52] U.S. Cl. ..... 414/658; 414/403
[58] Field of Search ..... 414/168, 178, 180, 182, 414/185, 403, 592, 594, 595, 598, 599, 600, 601, 602, 604, 605, 657, 658

[56] References Cited

U.S. PATENT DOCUMENTS

| | | | |
|---|---|---|---|
| 1,317,366 | 9/1919 | Greenough et al. | 414/592 |
| 2,649,983 | 8/1953 | Finlay et al. | 414/658 X |
| 2,790,569 | 4/1957 | Leonard | 414/658 |
| 2,828,041 | 3/1958 | Leonard | 414/658 |
| 2,969,886 | 1/1961 | Taylor et al. | 414/658 |
| 2,995,264 | 8/1961 | Thomas | 414/658 |
| 3,052,367 | 9/1962 | Clark | 414/658 |

FOREIGN PATENT DOCUMENTS

| | | | |
|---|---|---|---|
| 1195675 | 6/1965 | Fed. Rep. of Germany | 414/658 |
| 1212262 | 3/1966 | Fed. Rep. of Germany | 414/657 |
| 0206031 | 6/1968 | U.S.S.R. | 414/604 |
| 292510 | 6/1929 | United Kingdom . | |
| 576383 | 4/1946 | United Kingdom . | |
| 873289 | 1/1960 | United Kingdom . | |
| 2104495 | 3/1983 | United Kingdom . | |
| 2127794 | 4/1984 | United Kingdom . | |

*Primary Examiner*—Robert J. Spar
*Assistant Examiner*—James Keenan
*Attorney, Agent, or Firm*—Michael L. Dunn

[57] ABSTRACT

A skip to be suspended in a mine shaft has a discharge opening at the lower end region of a chamber defined by a skip body. A door closes the opening and can open to discharge material from the chamber. Door operating members at opposite sides of the body are pivotable about a common axis between a closed position in which the door is closed and an open position in which the door is open. Connectors connect the members and the door and the connectors cross the pivot axis as the door moves between the open and closed positions. The connectors can be at least partly flexible. It is desirable for the chamber to be generally of a greater cross-sectional area at a level above the operating members than at the level of the members and for the body to extend above and at least partly cover the operating members.

17 Claims, 6 Drawing Sheets

SKIP

In modern mining conditions, there is a need to maximise the mass of material which can be moved up a mine shaft in a single skip operation. For this purpose, it is desirable to have the greatest possible interior volume and the lightest possible skip. While lighter materials are often prone to wear or relatively costly, or both, and the design parameters of any skip are limited by particular mine shaft designs, there is a real need for improved skips to meet mining requirements.

The applicant has developed a skip intended to operate with the head gear of a conventional mine without substantial changes to the mine shaft, while having the abovementioned design criteria in mind.

According to one aspect of the invention, there is provided a skip to be suspended in a mine shaft and comprising a body defining a normally downwardly extending storage chamber, a discharge opening defined by the body at the lower end region of the chamber, a door for closing the discharge opening, the door being openable to allow material to be discharged from the chamber, and a door operating mechanism including door operating members mounted at opposite sides of the body and pivotable about a common axis and connectors connecting the members to the door, the door operating members being movable between a first position in which the members and connectors hold the door in its closed condition and a second position in which the door is in its open condition, and the connectors crossing the axis as the door moves between the open and closed positions.

Such an arrangement allows the connectors to be rigid or flexible members and according to a second aspect of the invention, there is provided a skip to be suspended in a mine shaft and comprising a body defining a normally downwardly extending storage chamber, a discharge opening defined by the body at the lower end region of the chamber, a door for closing the discharge opening, the door being openable to allow material to be discharged from the chamber, and a door operating mechanism including door operating members mounted at opposite sides of the body and connected to the door at least partly by flexible connectors, the door operating members being lockable in a first position in which the members and connectors hold the door in its closed condition and being movable to a second position in which the door is in its open condition.

Each connector may be a cable connected to a respective member and to the door. For the purpose of this specification the term "cable" includes a rope, chain or wire or a number of flexibly connected links, a wire cable, or a composite cable including rope, chain or wire together with one or more links or other rigid elements.

The connectors may be attached to the members and door by connecting parts pivotally attached to the members and door.

The body may have an upper part of greater cross-sectional area than a part below it with the upper part extending above and substantially covering the operating members. This can have the advantage that the operating members can be protected at least to some extent from falling material in a mine shaft and also from accidental engagement with projections in the shaft. This can increase skip safety.

In contrast with earlier skips known to the applicant, the applicant also envisages the upper part of the skip body being wider than normal, increasing the volume of the chamber.

According to another aspect of the invention, there is provided a skip to be suspended in a mine shaft and comprising a body defining a normally downwardly extending storage chamber, a discharge opening defined by the body at the lower end region of the chamber, a normally closed door openable to allow material to be discharged from the chamber through said opening, and a door operating mechanism including door operating members mounted at opposite sides of the body for rotation about a common axis and also including connectors connecting the door directly or indirectly to the members, the door operating members being locatable in a first position in which the door is held in its closed condition and being movable to a second position in which the door is in its open condition, the connectors crossing said axis when the door moves between the said conditions, the chamber being generally of a greater cross-sectional area at a level above the operating members than at the level of the members and the body extending over the operating members.

In this aspect of the invention, the operating members may again be connected to the door at least partly by cables.

In each skip, the body may have a peripheral wall bordering the chamber and an integral sloping bottom adjacent to the discharge opening for directing material towards the opening, the sloping bottom extending from a top portion to a bottom portion adjacent to a bottom portion of the discharge opening.

The cross-sectional area of the chamber may be generally square or rectangular in plan view.

In order to inhibit wearing of the inner surface of the wall, the inside of the peripheral wall of the skip may be provided with deflectors for deflecting downwardly moving material inwardly away for the inside of the wall.

The door, which may be pivotally mounted on the body in any suitable manner, may be pivotable downwardly for adopting a position defining a chute surface beneath the opening to allow material to be discharged from the chamber and guided away from the opening. The door may be pivotable about an axis adjacent to the bottom portion of the sloping bottom. For example, the door may be attached to a pivot bar by suitable trunnions at opposite sides of the door to provide for necessary movement of the door while keeping adjacent edges of the bottom and door in a relationship for substantially preventing passage of material between them at the junction.

In a preferred embodiment the connectors may be attached to the door by a yoke having a central region movably connected to the door and its end regions attached to the connectors so that the yoke compensates for uneven opening of the door.

The door operating mechanism may use any suitable arrangement for locating the operating members in position for holding the door of the skip in its closed condition. An over-centre arrangement is particularly suitable for this purpose. In a preferred embodiment, the members may be over-centre members movable to over-centre positions releasably to lock the door in its closed condition, the over-centre members being arranged so that the load on the door and the weight of the door itself bias the members to remain in this locked, over-centre condition.

Each over-centre member may thus be arranged so that the connector extending between that member and the yoke is on one side of the pivot axis of that member when the member is in its over-centre condition and is movable to the opposite side of that axis to allow the door to open. Any forces applied to the connector from the closed door will extend along the cable and will serve to retain the mechanism in its over-centre condition until the member is pivoted.

The members may, if desired, be provided with releasable latches to provide an additional mechanical lock.

Followers can be connected to the door operating members and be movable by operating arrangements, such as suitably located cam tracks in the mine shaft to move the members and release the mechanism from its locked over-centre condition as the skip moves upwardly in the shaft, enabling the door to move to its open position. If latches are provided to lock the members in position, these may also be released by suitable cam action in a similar way.

The invention also extends to a mine having a shaft with a head at the upper end of the shaft, and a skip according to any aspect of the invention mounted and guided for vertical movement in the shaft, wherein the head has operating arrangements for releasing the operating members of the skip during upward movement of the skip to allow the door to move from the first position to the second position as the skip moves upwardly in the head and so for discharging the contents of the skip at a predetermined location, wherein the head also has support means for supporting the door as it moves from the first to the second position.

The movement of the door can thus be controlled so that the door does not simply fall and does not have to be supported by the members as it opens. The support means can help to prevent the door and the material supported by it from exerting substantial loading on the operating mechanism during the opening movement of the door.

The support means may be one or more rollers or a support bar in the head and arranged to engage contact surfaces on the door during the movement of the door.

The head may also have return means for returning the door to its closed condition and the operating members to the locked first position as the open skip moves downwardly in the head after the skip has discharged its contents.

Embodiments of the invention will now be described, by way of example, with reference to the accompanying schematic drawings, in which FIG. 1 is a side view of a skip in a mine shaft;

In the various drawings, like reference numerals are used to identify like parts.

Figure 1:
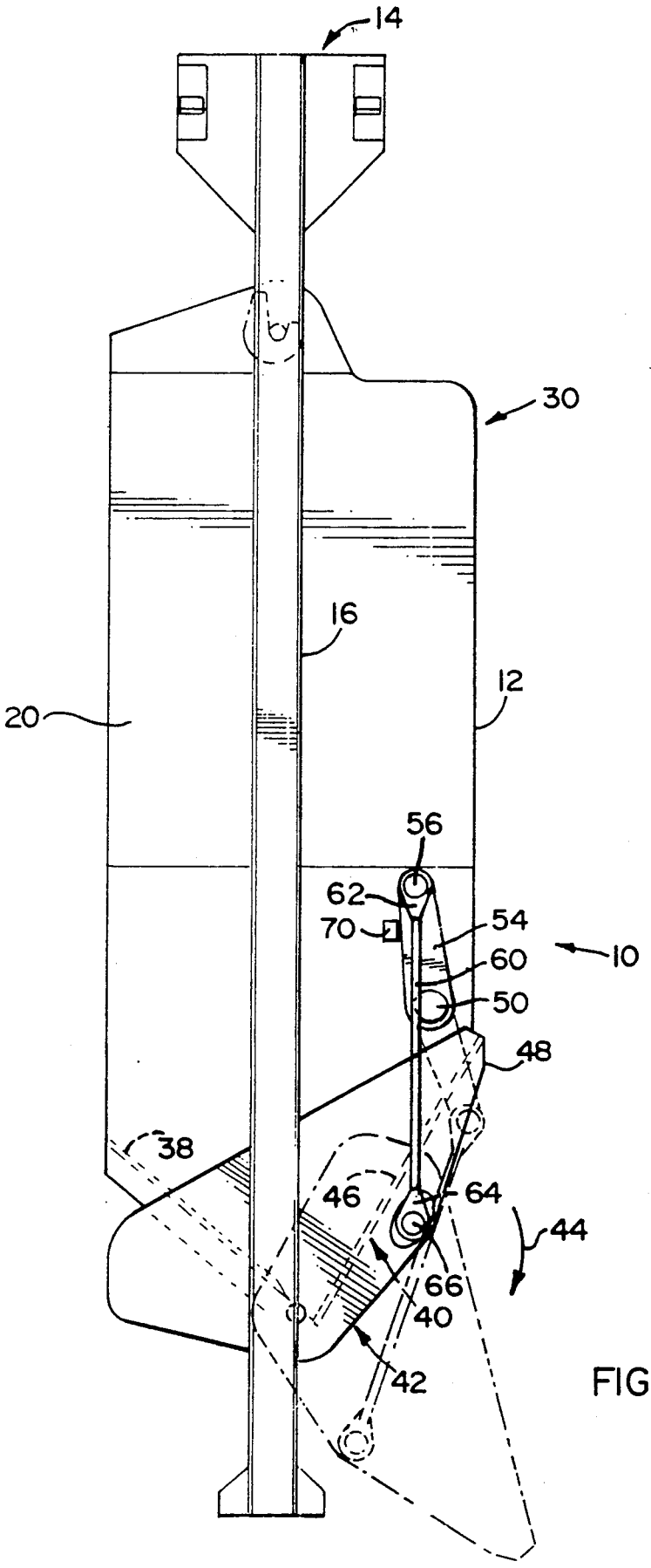
Figure 2:
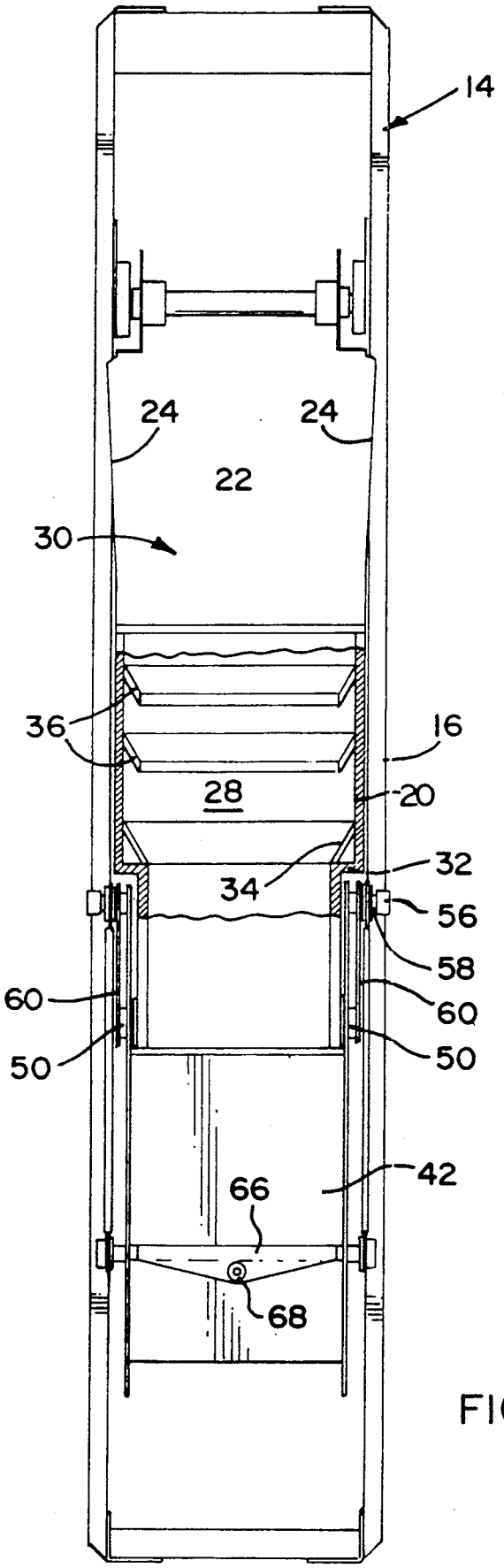
FIG. 2 is a partially sectional front view showing the closed skip.
Figure 3:
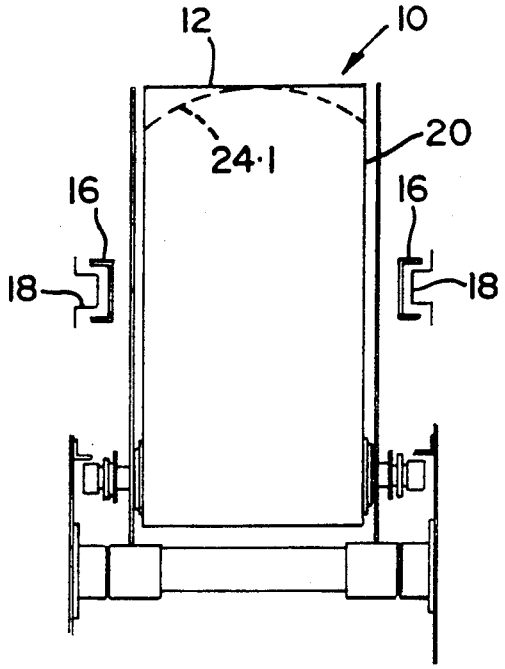
FIG. 3 is a plan view of the skip in a shaft.

Referring to the drawings in more detail, skips 10 are mounted in mine shafts for movement up and down the shaft. In FIGS. 1 to 3, the skip has a body 12 mounted and suspended in a conventional manner in a Job's bridle 14 providing channels 16 to engage and be guided by skip guides 18 fixed in the mine shaft.

Figure 4:
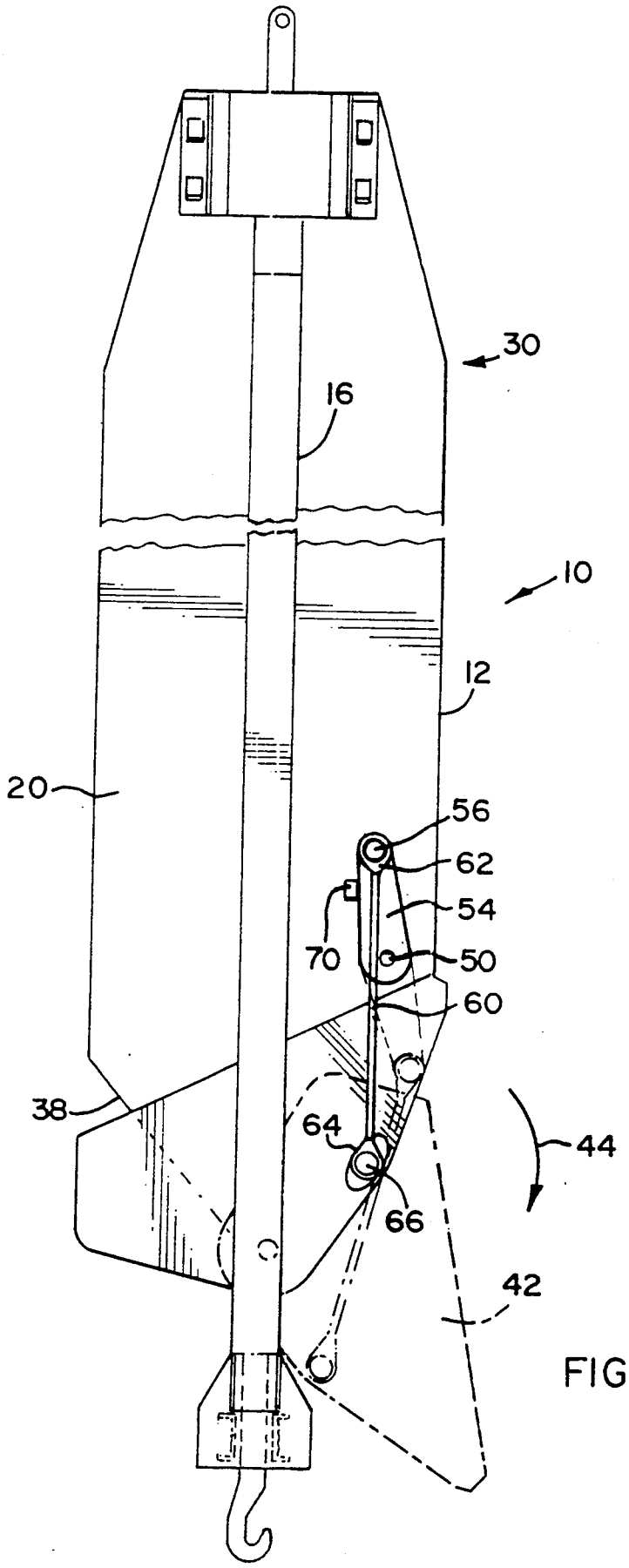
FIG. 4 is a side view of a second skip.
Figure 5:
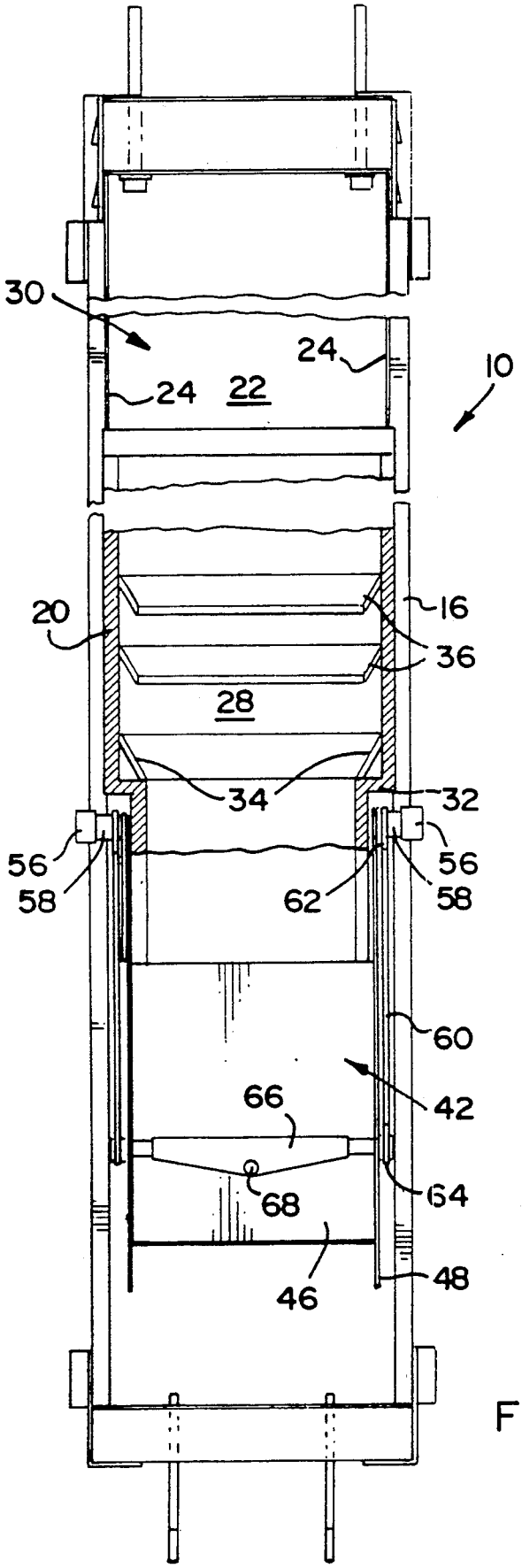
FIG. 5 is a partly sectional front view of the second skip.
Figure 6:
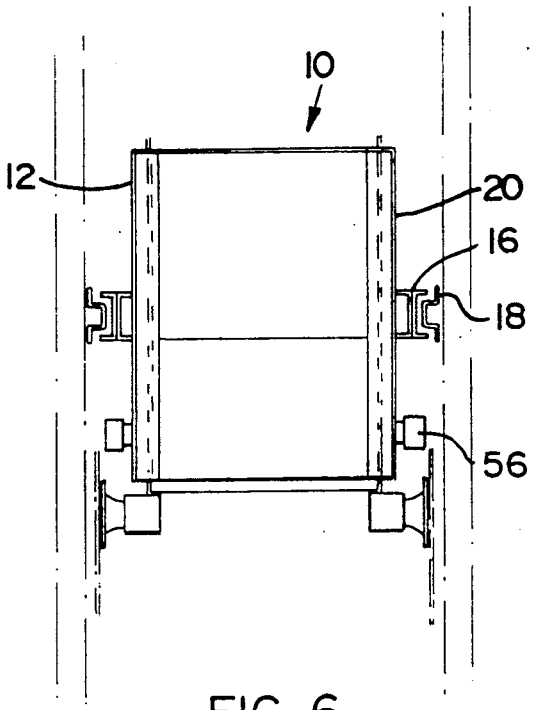
FIG. 6 is a plan view of the second skip in a mine shaft.
Figure 8:
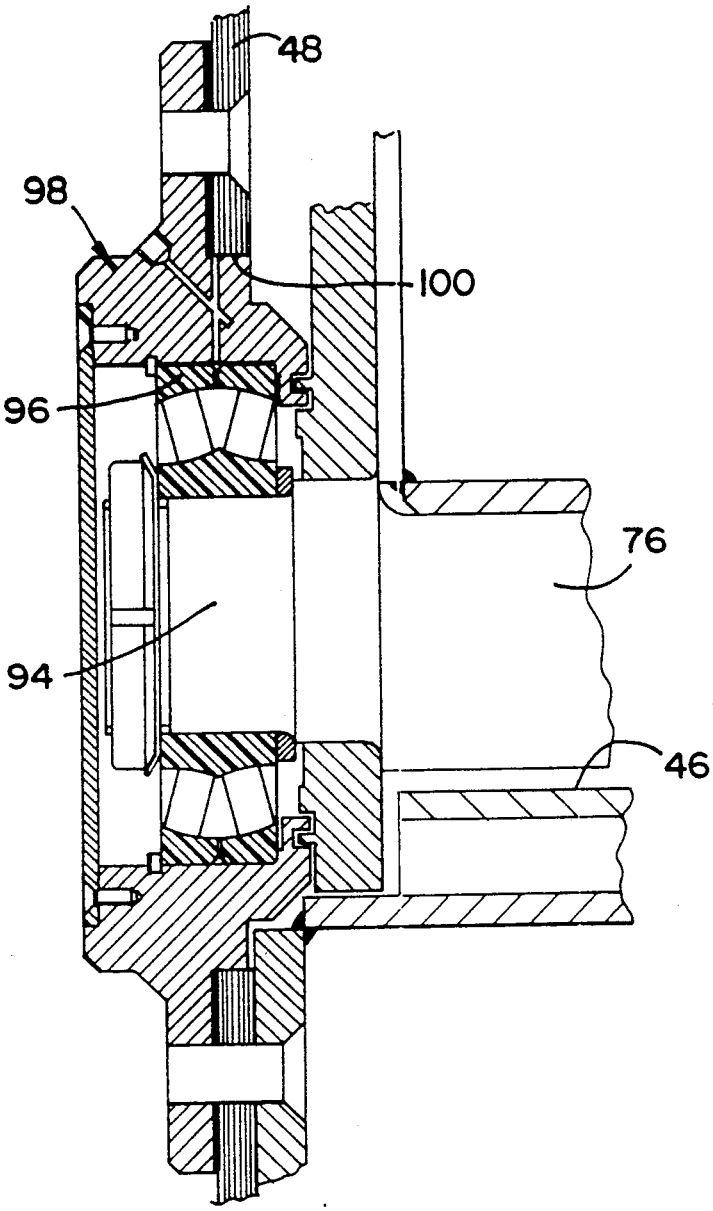
FIG. 8 is a cross-section through a pivot for the door.

In FIGS. 4 to 6, channels 16 to be guided by skip guides 18 are fixed directly to the body 12.

Each skip body 12 has a peripheral wall 20 of rectangular cross-section, in plan view, along the major part of its height. Each skip also has an upper rear wall 22 and upper side walls 24 so that, at its upper end, the body is provided with a feed opening 30 between the side walls for receiving material from a loading flask and a feeder chute. Because in-flowing material is directed at the rear wall, the wall can be curved as shown at 24.1 in FIG. 3 in order to try to reduce the effect of the in-flowing material on the wall.

Each wall 20 borders and substantially defines a storage chamber 28 of generally rectangular cross-section in plan view. The cross-sectional area of this chamber is greater towards the top of the chamber, and particularly in the zone from just below the feed opening to the region of shoulders 32 at opposite sides of the body 18. Inclined deflector plates 34 extend along the upper surfaces of the shoulders and deflectors 36 are welded to the inside surface of the wall 20 in that part of the chamber above the shoulders 32. These deflectors are at suitable distances apart for deflecting downwardly moving material inwardly away from the wall.

The bottom of each skip is partially closed by a sloping bottom 38 which is inclined downwardly at a suitable angle with respect to the central vertical plane of the skip. It extends over approximately half of the area of the bottom of the skip. A discharge opening 40 is defined between a bottom portion of the sloping bottom 38 and part of the wall 20 of the body of each skip and is normally closed by a door 42. The door and body can be provided with wear plates in a suitable manner.

Each door 42 is movable from a closed condition in which it closes the opening 40, in the direction of arrows 44, until it reaches the open position shown in chain lines in FIGS. 1 and 4. In this open position, the bottom 38 and a plate structure 46 of the door of each skip from a chute for guiding material flowing from the skip. Each door is provided with side plates 48 to further improve the guiding of the material.

The door of each skip shown is normally held in its closed condition by a door operating mechanism including over-centre members 54 mounted at opposite sides of the body. Each such member carries a follower 56 on a pivot shaft 58 at one end region and is pivotally connected to a respective pivot 50 on the body at its other end region, the pivots 50 of each skip having a common central axis. Connectors 60 are each connected to a respective member 54 by being attached to a connecting ring 62 on a respective pivot shaft 58. The connecting rings are located between the followers 56 and the members 54.

The other ends of the connectors 60 of each skip are connected to respective connecting rings 64 pivotally mounted on the opposite ends of a respective yoke 66. Each yoke 66 is an elongated member extending across the width of the respective door and having its central region pivotally but securely connected to a mount 68 at a central region of the door. The movement of each yoke is limited to movement through a limited angle in planes substantially perpendicular to and parallel to the plane of the door and serves to compensate for irregular movement resulting from bending or flexing in the operating mechanism and skip.

As shown in FIGS. 2 and 5, each member 58 is mounted so that, with the respective door in its normal closed condition, the member rests against a stop 70 on the body in a locked over-centre condition.

In this position, each connector 60 is on one side of the common axis of the pivots 50 so that the door is held in its closed condition. Thus, when the door is in the closed condition, forces applied to the closed door by a load in the skip and the weight of the door itself serve to provide a force along the cable and to increase the locking effect of the mechanism. The door is opened by causing each follower 56 to follow a door-opening path so that the connectors cross the axis of the pivots 50, moving the members 54 from the over-centre position.

Although the connectors 60 may be substantially straight rods, the connectors shown may be flexible connectors, such as cables or chains, which allows for a degree of flexibility in the door operating mechanism.

Figure 7:
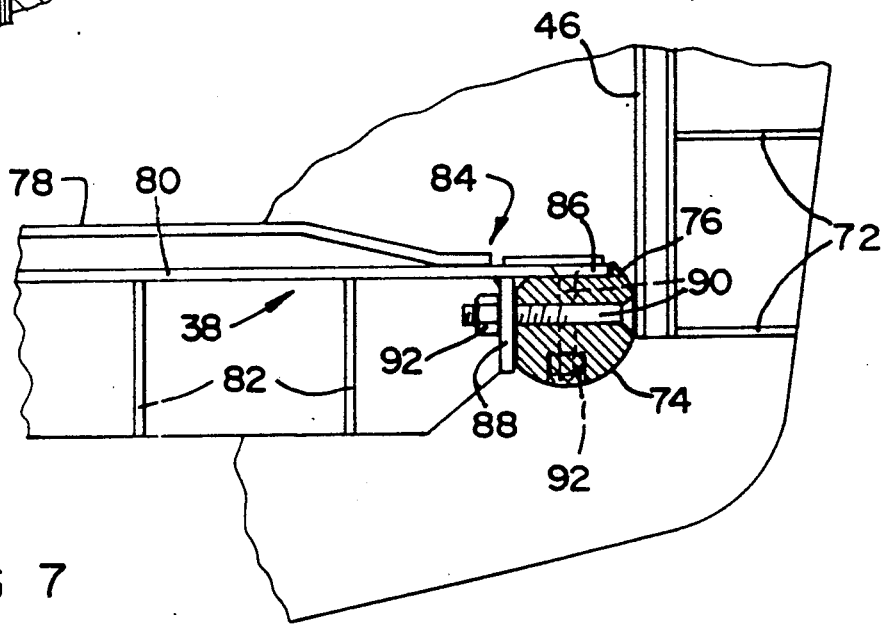
FIG. 7 is a cross-section at the junction of the door and body of either skip.

In order to mount the door on each skip for satisfactory operation, each door has its plate structure 46 fixed rigidly to the side plates 48 as shown in FIG. 7. Each plate structure 46 is made of two spaced plates reinforced by transverse reinforcing webs 72 welded to the plates and to the side plates 48.

One end of the plate structure 46 lies close to and almost tangentially to an outer surface 74 of a pivot bar 76 fixed rigidly to the sloping bottom 38 of the respective skip.

Each sloping bottom 38 is formed from two plates 78 and 80 welded together and to the peripheral wall of the body with suitable reinforcing material between them, where necessary. The plate 80 is also supported by transverse webs 82 welded to the plate 80 and to the peripheral wall of the body.

In the region of the junction between the door and the sloping bottom, the plates 78 and 80 are fixed together at 84, with a free end 86 of the plate 80 extending beyond the plate 78. This free end 86 is provided with a mounting strip 88 across substantially the whole of its width so that the free end 86 and strip 88 form an angle section. The pivot bar 76 is bolted to the free end 86 and strip 88 by countersunk bolts 90 and nuts 92.

Each pivot bar 76 has outer ends 94 on which bearings 96 are mounted and these bearings carry bearing housings 98. The specific construction of the bearing housings 98 is not critical but they must be suitably robust and adequately sealed for use in mining conditions.

The bearing housings 98 are fitted in openings 100 in the side plates 48 of the door, the plate structure 46 of the door being located away from the axis of each opening 100 so that it can lie substantially on a tangent to the outer surface of the pivot 76 as mentioned above.

With this arrangement, the end of the plate structure 46 moves along the periphery of the bar 76 during movement of the door, to restrict the passage of material between the door and bottom and to reduce the likelihood of jamming of the door during its operation as a result of material becoming trapped between the door and bottom.

Figure 9:
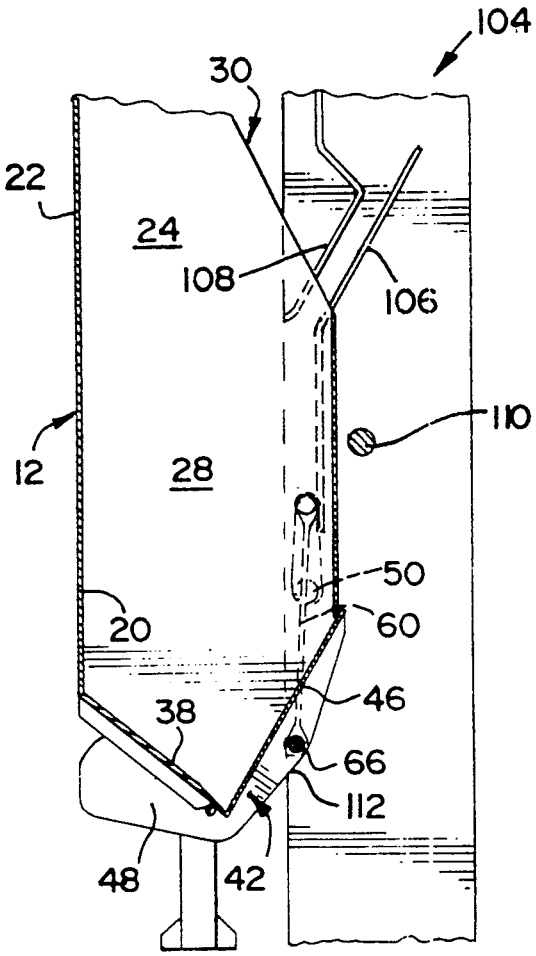
FIG. 9 shows a skip moving to a discharge station in a mine shaft.
Figure 10:
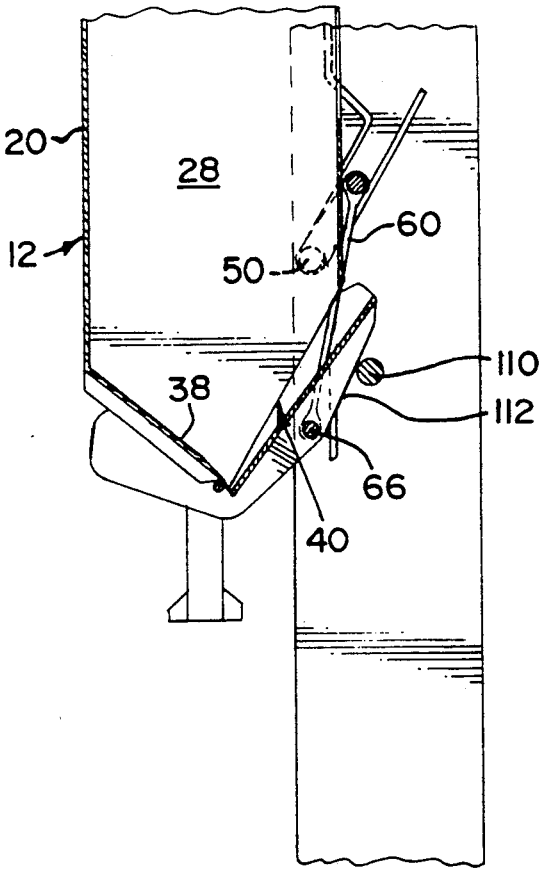
FIG. 10 shows the skip as it begins to open.
Figure 11:
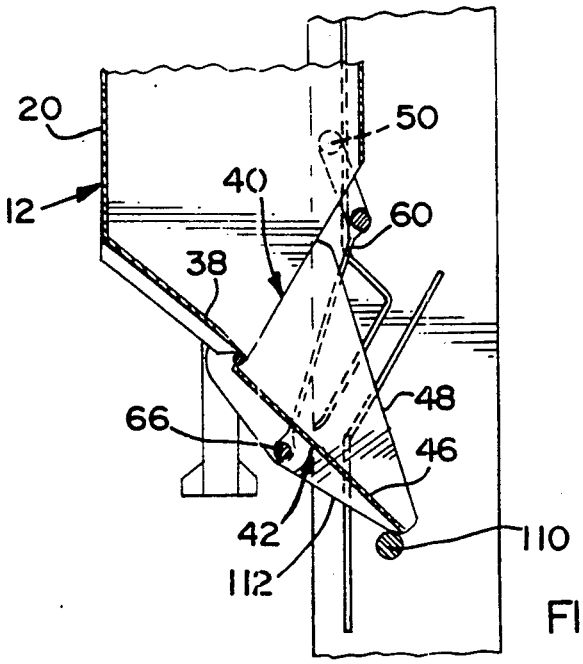
FIG. 11 shows the skip in its fully open condition.

The operation of each skip is illustrated with reference to FIGS. 9 to 11.

In order to cause the followers 56 to follow a door-opening path, the skip is used in a mine shaft with a skip head 104 which includes pairs of cam tracks, each including tracks 106 and 108, arranged on opposite sides of the skip head for receiving and engaging the followers 56.

When the skip moves upwardly into the skip head it is guided by the skip guides and the followers 56 move upwardly to strike the cam tracks 108. The cam tracks 108 force the followers to move the members 54 from their over-centre locked condition as shown in FIG. 10. A roller bar 110 is provided in the skip head and is located to be engaged by suitable edge surfaces 112 of the door plates 48 as soon as the door starts to open so that the roller bar supports the door to prevent excessively rapid opening of the door once the members 54 have moved from the over-centre condition. The bar 110 supports the door until the door is fully open.

When the skip is again moved downwardly, bar 110 supports the door and moves it towards its closed condition while the cam tracks 106 force the followers 56 to move in the opposite direction and, in due course, force the members 54 to return to the over-centre condition.

What I claim is:

1. A skip to be suspended in a mine shaft and comprising a body defining a normally downwardly extending storage chamber, a discharge opening defined by the body at a lower end region of the chamber, a door for closing the discharge opening, the door being openable to allow material to be discharged from the chamber, and a door operating mechanism including door operating members mounted at opposite sides of the body and pivotable about a common axis and connectors connecting the members to the door, the door operating members being movable between a first position in which the members and connectors hold the door in its closed condition and a second position in which the door is in its open condition, and the connectors being attached to the door by a yoke having a central region movably connected to the door and end regions to which the connectors are attached so that the yoke compensates for uneven opening of the door.

2. A skip to be suspended in a mine shaft and comprising a body defining a normally downwardly extending storage chamber, a discharge opening defined by the body at a lower end region of the chamber, a door for closing the discharge opening, the door being openable to allow material to be discharged from the chamber, and a door operating mechanism including door operating members mounted at opposite sides of the body and connected to the door at least partly by flexible connectors, each of which is a cable connected to a respective member and to the door, the door operating members being lockable in a first position in which the members and connectors hold the door in its closed condition.

3. A skip according to claim 2, wherein the connectors are attached to the members and door by connecting parts pivotally attached to the members and door.

4. A skip according to claim 2, wherein the body has an upper part of greater cross-sectional area than a part below it with the upper part extending above and substantially covering the operating members.

5. A skip to be suspended in a mine shaft and comprising a body defining a normally downwardly extending storage chamber, a discharge opening defined by the body at a lower end region of the chamber, a normally closed door openable to allow material to be discharged from the chamber through said opening, a door operating mechanism including door operating members mounted at opposite sides of the body for rotation about a common axis and also including connectors connecting the door directly or indirectly to the members, said connectors being attached to the door by a yoke having a central region movable connected to the door and end regions to which the connectors are attached so that the yoke compensates for uneven opening of the door, the door operating members being locatable in a first position in which the door is held in its closed condition and being movable to a second position in which the door is in its open condition, the connectors crossing said axis when the door moves between said conditions, the chamber being generally of a greater cross-sectional area at a level above the operating members than at the level of the members, and the body extending over the operating members.

6. A skip according to claim 5, wherein the operating members are connected to the door at least partly by cables.

7. A skip according to claim 1, wherein the body has a peripheral wall bordering the chamber and an integral sloping bottom adjacent to the discharge opening for directing material towards the opening, the sloping bottom extending from a top portion to a bottom portion adjacent to a bottom portion of the discharge opening.

8. A skip according to claim 7, wherein the inside of the peripheral wall of the skip is provided with deflectors for deflecting downwardly moving material inwardly away from the inside of the wall.

9. A skip according to claim 8, wherein the door is pivotable downwardly for adopting a position defining a chute surface beneath the opening to allow material to be discharged from the chamber and guided away from the opening, the door being pivotable about an axis adjacent to the bottom portion of the sloping bottom and being attached to a pivot bar by suitable trunnions at opposite sides of the door to provide for necessary movement of the door while keeping adjacent edges of the bottom and door in a relationship for substantially preventing passage of material between them at their junction.

10. A skip according to claim 2, wherein the members are over-centre members movable to over-centre positions releasably to lock the door in its closed condition, the over-centre members being arranged so that the load on the door and the weight of the door itself bias the members to remain in this over-centre condition.

11. A skip according to claim 10, wherein followers are connected to the door operating members and are movable by suitably located cam tracks in a mine shaft to move the members and release the mechanism from its locked over-centre condition as the skip moves upwardly in the shaft, enabling the door to move to its open position.

12. A mine having a shaft with a head at the upper end of the shaft, and a skip according to claim 1 mounted and guided for vertical movement in the shaft, wherein the head and skip have co-operating arrangements for causing movement of the operating members of the skip during upward movement of the skip to allow the door to move from the closed condition to the open condition as the skip moves upwardly in the head and so for discharging the contents of the skip at a predetermined location, wherein the head also has support means for supporting the door as it moves from the first to the second position.

13. A mine according to claim 12, wherein the support means comprises at least one roller or a support bar in the head and arranged to engage contact surfaces on the door during the movement of the door.

14. A mine according to claim 13, wherein the head is adapted for returning the door to its closed condition and the operating members to the first position as the open skip moves downwardly in the head after the skip has discharged its contents.

15. A skip according claim 2, wherein the body has a peripheral wall bordering the chamber and an integral sloping bottom adjacent to the discharge opening for directing material towards the opening, the sloping bottom extending from a top portion to a bottom portion adjacent to a bottom portion of the discharge opening.

16. A skip according to claim 5, wherein the body has a peripheral wall bordering the chamber and an integral sloping bottom adjacent to the discharge opening for directing material towards the opening, the sloping bottom extending from a top portion to a bottom portion adjacent to a bottom portion of the discharge opening.

17. A skip according to claim 1, in which the connectors cross said axis as the door moves between the open and closed conditions.

* * * * *

UNITED STATES PATENT AND TRADEMARK OFFICE

CERTIFICATE OF CORRECTION

PATENT NO. : 5,122,028

DATED : June 16, 1992

INVENTOR(S) : Robert Montague Joubert

It is certified that error appears in the above-identified patent and that said Letters Patent is hereby corrected as shown below:

Column 7, line 6, "movable" should read --movably--.

Column 7, line 32, the dependency should be from claim 7 rather than Claim 8.

Signed and Sealed this

Third Day of August, 1993

Michael K. Kirk

*Attest:*

MICHAEL K. KIRK

*Attesting Officer*

*Acting Commissioner of Patents and Trademarks*